US005504510A

United States Patent [19]

Miyakawa

[11] Patent Number: 5,504,510

[45] Date of Patent: Apr. 2, 1996

[54] INK LOADING DEVICE, RECORDING APPARATUS HAVING SAME AND INK LOADING METHOD

[75] Inventor: Akira Miyakawa, Yokohama, Japan

[73] Assignee: Canon Kabushiki Kaisha, Tokyo, Japan

[21] Appl. No.: 172,165

[22] Filed: Dec. 23, 1993

[30] Foreign Application Priority Data

Dec. 25, 1992 [JP] Japan ..... 4-358296

[51] Int. Cl.[6] ..... B41J 2/17

[52] U.S. Cl. ..... 347/85

[58] Field of Search ..... 347/85, 86, 87, 347/14

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,383,263 | 5/1983 | Ozawa et al. | 347/86 |
| 4,419,677 | 12/1983 | Kasugayama et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 6/1986 | Hori | 346/140 R |
| 4,723,129 | 2/1988 | Endo et al. | 346/1.1 |
| 4,740,796 | 4/1988 | Endo et al. | 346/1.1 |
| 4,967,207 | 10/1990 | Ruder | 346/140 R |
| 4,968,998 | 11/1990 | Allen | 346/140 R |
| 5,199,470 | 4/1993 | Goldman | 347/85 |
| 5,329,294 | 7/1994 | Ontawar et al. | 347/87 |

FOREIGN PATENT DOCUMENTS

| | | | |
|---|---|---|---|
| 412459 | 2/1991 | European Pat. Off. | 347/87 |
| 649429 | 8/1991 | European Pat. Off. | 347/86 |
| 227629 | 10/1991 | European Pat. Off. | 347/14 |
| 0509747 | 10/1992 | European Pat. Off. . | |
| 0509687 | 10/1992 | European Pat. Off. . | |
| 4101695 | 8/1992 | Germany . | |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 3101970 | 4/1991 | Japan . | |
| 4250068 | 9/1992 | Japan . | |

*Primary Examiner*—N. Le

*Attorney, Agent, or Firm*—Fitzpatrick, Cella, Harper & Scinto

[57] ABSTRACT

An ink refilling apparatus for loading ink into a recording ink cartridge having an ink discharging outlet, and an air vent for communication with ambience includes a filling ink cartridge for containing ink to be used for refilling the recording ink cartridge; a pressure controller having a first pressure controlling portion for controlling a pressure of the ink outlet and a second pressure controlling portion for controlling a pressure of the air vent; pressure a transmitter for transmitting a pressure variation of the second pressure controlling portion to the filling ink cartridge.

5 Claims, 13 Drawing Sheets

INK LOADING DEVICE, RECORDING APPARATUS HAVING SAME AND INK LOADING METHOD

FIELD OF THE INVENTION AND RELATED ART

The present invention relates to an ink loading apparatus for loading ink to a recording means which ejects liquid such as ink or the like, a recording apparatus having the ink loading device, and an ink loading method, more particularly to an ink refilling apparatus for refilling a recording ink cartridge with ink, the cartridge being detachably mountable relative to a recording apparatus, and an ink jet recording apparatus having the refilling apparatus.

In a recording apparatus such as a printer, a copying machine, a facsimile machine or the like, and a recording apparatus used as an output apparatus of a compound apparatus or work station including computer or wordprocessor, images (characters and symbols) are recorded on a recording material such as paper or plastic resin material thin sheet (OHP sheet or the like) in accordance with image information. The recording machines are classified into an ink jet type, a wire dot type, a heat sensitive type, a heat transfer type, a laser beam type or the like, depending on the recording system of the recording means. In a serial type recording apparatus in which a recording head is moved in a main scan direction transverse with the recording material feeding direction (sub-scan direction), the recording material is placed at a predetermined recording position, and thereafter, a recording means (recording head) carried on a carriage movable in the main scan direction along the recording material scans the recording material to effect the recording of the image (character symbols or the like). After completion of one line recording, the recording material is fed through a predetermined distance (sub-scan). Subsequently, the next line is recorded (main scan). This is repeated, so that an image is recorded in a desired range of the recording material. On the other hand, in a line type recording apparatus in which the scanning operation is only the feeding of the recording material, the recording material is placed at a predetermined recording position, and one line is recorded all at once, while the recording material is fed at a predetermined pitch, so that the image is recorded on the entire surface of the recording material.

Among them, an ink jet type (ink jet recording apparatus) is such that the ink is ejected from recording means (recording head) onto the recording material to effect the recording. The ink jet type is advantageous in that the size of the recording material can be reduced; that high resolution images can be recorded at high speed; that plain paper is usable without special treatment; that the running cost is low; that the noise level is low (non-impact type); and that it is easy to effect color recording with the use of different color inks.

The ink jet type recording apparatus is used for recording images or the like on cloth, that is, for textile printing.

In the ink jet type recording apparatus, an ink jet type recording means for ejecting ink using thermal energy is advantageous in that it is easy to manufacture liquid passages (ejection outlets) at high density by forming electrothermal transducers, electrode, liquid walls and top plates on a base plate through a semiconductor manufacturing process including etching, evaporation, sputtering or the like. Therefore, the size can be further reduced. By using the advantageous of the IC technology and micro-machining technology, it is easy to provide a long recording means or two dimensional recording means, and therefore, the recording means can be in the form of a full-line multi-nozzle head, or a high density recording head.

The ink jet recording apparatus is equipped with an ink container for supplied ink to the recording means (recording head). As a form of the ink container, a cartridge type (replaceable) is widely used. The ink cartridge may be in the form of a simple ink container, or it may be unified with a recording head. Therefore, in this application, "ink cartridge" covers both, and it means a replaceable cartridge, at least a part of which constitutes an ink container. The ink cartridge will be called "recording ink cartridge" for the purpose of distinction from a filling ink cartridge which is only an ink container for containing an ink for filling said ink cartridge with ink. When a unified recording head and ink container is particularly meant, it is called "ink jet cartridge". There are two types of ink jet cartridges, i.e., the one having unified recording head and ink container, and the one having separable recording head and ink container.

The recent demands on the basis of the environmental problem and effective use of natural resources, increases the importance of reuse of the ink cartridge. Therefore, it is desired to provide an apparatus capable of refilling and ink container of the ink cartridge with ink. For the purpose of the refilling, a widely used method is as follows. An ink container in the form of a simple injector is mounted to a joint portion of the ink cartridge, and the ink container is collapsed to inject the ink into the ink cartridge, thus making the ink cartridge reusable.

However, in the refilling method using the ink container in the form of an injector, there are various problems in operation and in functions, which prevent increase the number of users. For example, when the injector is used for a disposable cartridge having unit head and container, the following inconveniences arise.

In the disposable recording head (ink cartridge), the inside thereof is separated into a head portion and an ink container portion, and the ink containing portion is filled with an ink absorbing material for retaining the ink. The ink is supplied to the head portion through a conduit from the ink absorbing material. The ink container is made of non-transparent material for the purpose of protecting the properties of the ink.

Therefore, when the container is to be refilled with the ink into the ink absorbing material after it becomes empty, the refilling degree has to be on the basis of guess because the inside of the container is invisible. If the ink is supplied too strongly or quickly, the ink flows more to the injection port, ejection port or connection port than is absorbed by the ink absorbing material with the result of contamination of the ambience.

Once the ink overflowing passage is established in the ink absorbing material, a larger amount of the ink than the amount retainable by the ink absorbing material, is flowed out through the overflowing passage having a smaller passage resistance. Therefore, even if the operator thinks that a predetermined quantity of the ink is ejected, the ink absorbing material does not retain the required amount of the ink.

The foreign matter introduced when the ink is loaded into the injector or when the ink is injected into the ink cartridge, may be introduced into the ink container with the result of clogging of the ink ejection outlet or the ink connection port. In addition, when the ink cartridge is in the operator's hand upon the injecting operation, the ejection side surface may be contaminated with the result of deteriorated ink ejection property. Furthermore, the operator's hand may be in contact with electric connectors for electric signal transfer, the static electricity accumulated in the human body may destroy the electric elements.

As for non-injector type ink refilling device, U.S. Pat. Nos. 4,968,998 and 4,967,207 or the like propose that an ink refilling apparatus is provided in the ink jet recording apparatus.

In U.S. Pat. No. 4,968,998, the following refilling system is disclosed. An ink containing portion integrally formed with the recording head is provided with an opening having a refilling tube, a vacuum port and an air vent. In the ink refilling operation, the ink is supplied into foams through a refilling tube while evacuating the air and the liquid toner through the vacuum port from the upper part of the foam material of the ink container. An end of the refilling tube is disposed at a lower part of the ink container not adjacent to a filter or ejector of the recording head. The air vent is disposed at a position different from the positions of the refilling tube and the vacuum port. However, when the ink is to be refilled into the container with this structure, the inside of the ink container is not uniformly in vacuum condition since the air vent is open. Conversely, if the sucking amount is increased, the air may be introduced into the recording head through the ink ejection outlets.

Since the end of the refilling tube is away from the recording head, there is a liability that the ink is not filled to the neighborhood of the recording head. Similarly, the air is pushed to the corners of the ink container with the possible result that the air remains in the ink container. In the filling step, the ink is injected while the sucking action is carried out, and therefore, in order to sufficiently supplied ink to the entirely of the ink retainer, a large quantity of the ink has to be used. For this reason, the usage efficiency of the ink for the refilling operation is low. Another method is disclosed in U.S. Pat. No. 4,967,207, in which the ink jet recording apparatus is provided with an ink refilling system. The disclosed refilling method is such that pressure in the inside of the ink container is reduced using an air vent has a vacuum port, and thereafter, the ink is supplied by an ink supply needle. An end of the needle is disposed at a position of a lower part of the ink container and not adjacent to a filter or ejector of the recording head.

It would be possible to maintain the vacuum state in the ink container prior to the ink ejection step, but since the needle for the ink supply is away from the recording head portion, there is a liability that an air layer is formed between a recording head and an ink container at the marginal positions if the complete vacuum is not established as disclosed there.

Accordingly, in the two structures described above, it is inevitable in order to remove the air layer around the recording head to effect a significant amount or number of sucking recovering operations after the refilling of the ink. In addition, the structures disclosed are fairly complicated. Moreover, the amount of the ink required for one refilling operation is larger than that retained in the ink retainer, so that the size of the ink containing portion of the refilling ink container has to be increased.

In order to provide a solution to the problem of the existence of the air layer around the recording head portion, Japanese Laid-Open Patent Applications Nos. 101970/1991 and 250068/1992 or the like.

In the Japanese Laid-Open Patent Application No. 101970/1991, the pressure inside the ink container is reduced, and thereafter, the ink is supplied through an ink supply port of the recording head from the ink container. The quantity of the refilled ink is controlled by extracting the ink through the air vent after the ink is spread sufficiently over the entirety of the porous material in the ink container, thus providing proper quantity of the ink retained by the porous material. With this structure, the formation of the air layer in the recording head portion can be prevented.

However, since a part of the ink once filled into the container is extracted out, and therefore, a larger amount of the ink than necessary amount of the ink required, and in addition, the structures for the ink ejection and the vacuum mechanism are complicated.

In Japanese Laid-Open Patent Application No. 250068/1992, a refilling method into a liquid container having an air vent and an ink supply port, is disclosed. The refilling process is as follows. The inside of the container is evacuated through the ink supply port while the air vent is closed to provide vacuum in the container. Thereafter, the ink is injected through the ink supply port. After the completion of the injection step, the air vent is opened, and the ink ejecting means is removed from the ejection inlet (supply port). With this refilling method, the problem of the formation of the ink passage connecting between the recording means and the ink container by introduction of the air through the ink injection port upon the removal of the ink ejection means at the end of the ink refilling operation, can be avoided. However, the complication of the apparatus is not avoided.

In consideration of the foregoing, the following points are desired for the ink refilling apparatus and ink refilling method.

1. Upon the completion of the ink refilling process, the ink passage between the recording head and the ink container is not blocked by the air layer therein. Then, after the ink refilling operation, the recovery step to permit the ink ejection of the recording head, can be reduced.
2. The quantity of the ink required for the ink refilling process is as close as possible to the quantity of the ink filled into the ink cartridge or ink jet cartridge. Then, the usage efficiency of the refilling ink can be increased, and the size of the device can be reduced.
3. The structure of the ink refilling apparatus is simplified. Then, the size of the apparatus can be reduced.
4. The refilled ink cartridge still capable of providing high quality printing.

SUMMARY OF THE INVENTION

Accordingly, it is a principal object of the present invention to provide an ink refilling method and apparatus and an ink jet recording apparatus having the same by which the ink can be refilled to an ink cartridge without difficulty, with high efficiency, without contamination of operator's hands, with compact structure and in short period.

It is another object of the present invention to provide an ink refilling method, an ink refilling apparatus and an ink jet recording apparatus having the same with which a high quality recording can be performed with the refilled ink cartridge.

According to an aspect of the present invention there is provided an ink refilling apparatus for loading ink into a recording ink cartridge having an ink discharging outlet, and an air vent for communication with ambience, comprising: a filling ink cartridge for containing ink to be used for refilling the recording ink cartridge; pressure control means having a first pressure controlling portion for controlling a pressure of the ink outlet and a second pressure controlling portion for controlling a pressure of the air vent; pressure transmitting means for transmitting a pressure variation of the second pressure controlling portion to the filling ink cartridge.

The above apparatus may be such that the apparatus is operable in a first mode in which only the first pressure controlling portion is controlled to reduce a pressure in the first pressure controlling portion, a second mode in which the pressure in the first pressure controlling portion is reduced, and substantially simultaneously, a pressure of the second pressure controlling portion is increased, and a third mode in which only the second pressure controlling portion is controlled, and a pressure of the second pressure controlling portion is increased.

According to another aspect of the present invention, there is provided an ink jet recording apparatus having recording means for effecting recording by ejecting ink to a recording material, comprising: means for imparting relative movement between the recording means and the recording material; recovering means for recovering operation of the recording means; a filling ink cartridge containing ink to be loaded into a recording ink cartridge; pressure control means having a first pressure controlling portion for controlling a pressure of an ink discharging portion and a second pressure controlling portion for controlling a pressure of an air vent; pressure transmitting means for transmitting a pressure variation of the second pressure controlling portion to the filling ink cartridge.

According to a yet further aspect of the present invention, there is provided an ink refilling method for refilling an ink cartridge having an ink container provided with ink discharging outlet and an air vent for communication with ambience, comprising: a first step of establishing a pressure reduced state in the ink container by sucking air from inside of the ink container through the ink outlet with the air vent closed; and a second step, continuous to the first step, of pressurizing and injecting ink through the air vent while sucking air from inside of the ink container.

The above method may be such that a third step, continuous to the second step, of pressurizing and injecting ink through the air vent while sucking the air through the ink discharge outlet.

According to a further aspect of the present invention, there is provided an ink refilling apparatus for loading ink into a recording ink cartridge having an ink discharging outlet, and an air vent for communication with ambience, comprising: a filling ink cartridge for containing ink to be used for refilling the recording ink cartridge; pressure control means having a first pressure controlling portion for controlling a pressure of the ink outlet and a second pressure controlling portion for controlling a pressure of the air vent; pressure transmitting means for transmitting a pressure variation of the second pressure controlling portion to the filling ink cartridge, the apparatus further comprising storing means for storing information inherent to the recording ink cartridge, and another storing means for storing a number of ink refilling operations having been carried out to the recording ink cartridge.

With the present invention, the ink passage connecting the recording head and the ink container is assuredly established upon the completion of the ink refilling step, so that the ink disconnection due to the existence of the air layer or the like can be avoided. Therefore, the ink cartridge is usable as soon as the filling or loading operation is completed.

The use efficiency of the ink of the refilling ink can be increased so that the time required for the refilling operation can be reduced, with the advantageous results of size reduction and simplification. In addition, the high quality recording can be assured for the refilled ink cartridge.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
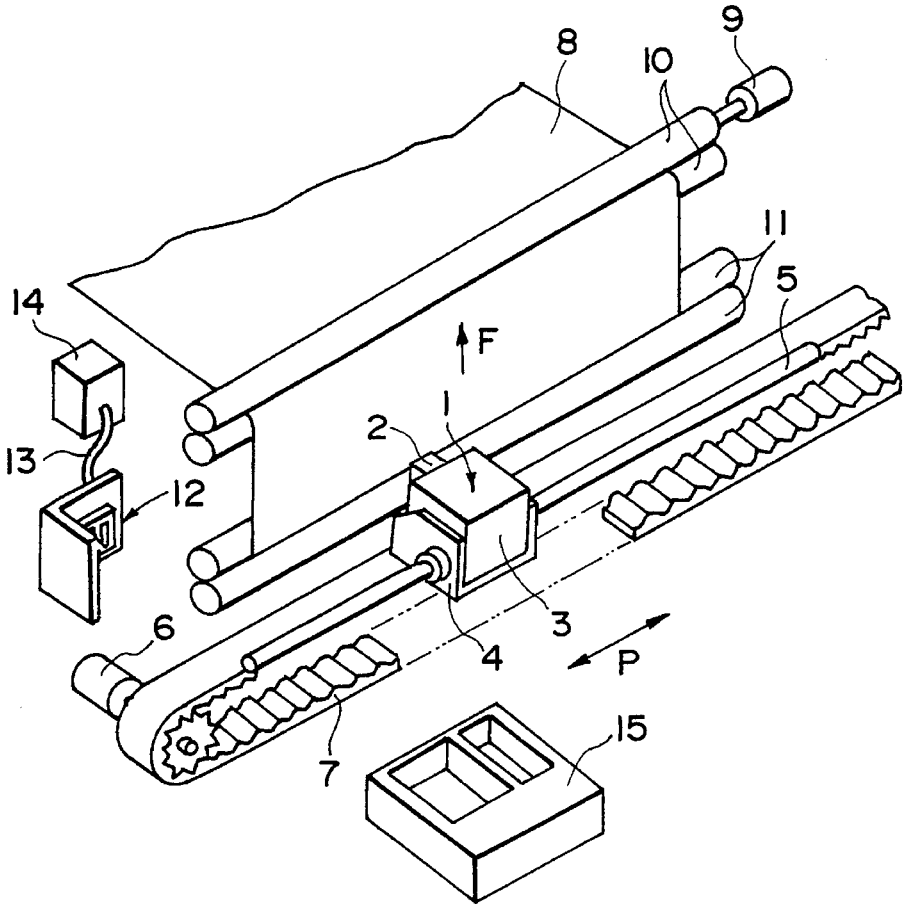
FIG. 1 is a schematic perspective view of an ink jet recording apparatus according to an embodiment of the present invention.

Referring to the accompanying drawings, the description will be made as to the embodiments of the present invention. Referring to FIG. 1, there is shown an ink jet recording apparatus according to a first embodiment of the present invention. In this Figure, the apparatus is usable with an ink cartridge having an integral recording means (recording head) 2 and an ink container 3. The cartridge 1 is carried detachably on a carriage 4. As described hereinbefore, "ink cartridge" means both of a cartridge having an integral recording head and ink container and a cartridge having only the ink container.

The carriage 4 is guided and supported for movement along the guide rail 5, and reciprocated in the double headed arrows P through a timing belt 7 by a carriage motor. A recording material 8 in the form of a sheet of paper or plastic resin material, is fed in a direction indicated by an arrow F at a predetermined timing and with a predetermined pitch along a predetermined path by a pair of feeding rollers 10 driven by a feeding motor 9 and a pair of holding rollers cooperative therewith.

While the recording material 8 is supported flat at a recording position faced to the recording means (recording head) 2, the carriage 4 is moved so that the recording operation is effected during the main scan in the direction P by the recording head 2. Upon completion of one line recording, the recording material F is stepped at a predetermined pitch corresponding to the width of the recording line the direction F. Then, the recording is effected for the next line. The ink cartridge 1 including the recording head 2 and the ink container 3 is ordinarily supported replaceably on the carriage 4.

At a predetermined position outside the recording area but in the movable range of the carriage 4, there is provided capping means 12 for hermetically capping the ejection side surface of the recording head 2. The capping means 12 is effective to hermetically seal the ejection outlet of the recording head 2, thus preventing viscosity increase or the solidification of the ink by drying, so that the ejection performance is maintained corrects. The capping means 12 is connected with a sucking pump 14 through a tube 13, so that a recovery mechanism is constituted for the recording head 2. With the recovery mechanism, when improper ejection due to the clogging of the ejection outlet of the recording head 2 or the like, a sucking pump 14 is operated while the ejection outlet is capped, by which the ink is sucked out through the ejection outlets to recover the ejection performance. At a predetermined position of the main assembly of the apparatus, there is provided an ink refilling apparatus 15 to refill (including initial filling) the recording ink cartridge 1 with the ink. In this embodiment, the ink refilling apparatus is provided in the ink jet recording apparatus. However, this is not limiting, and the separate ink refilling apparatus is usable when the size reduction of the ink jet recording apparatus is intended.

Figure 2:
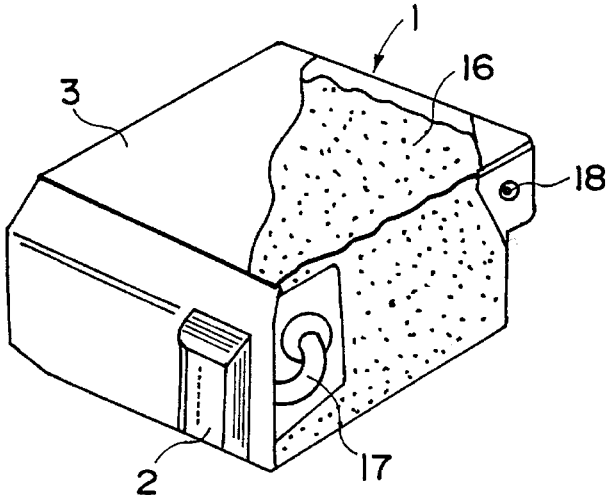
FIG. 2 is a partly broken perspective view of a recording ink cartridge usable with the ink jet recording apparatus.

FIG. 2 is a partly broken perspective view illustrating the structure of the ink cartridge detachably mountable to the carriage 4. In FIG. 2, the inside of the recording ink cartridge 1 is divided into a recording head 2 and an ink container 3. In the ink container 3, there is an ink absorbing material 16 for retaining the ink therein. The ink retained in the ink absorbing material 16 is supplied to a recording head 2 through a conduit 17, and is ejected through the ejection outlets by actuation of the recording head 2. Designated by a reference numeral 18 is an air vent for permitting communication between the inside of the ink container and the external ambience.

In this embodiment, the recording means (recording head) 2 is in the form of an ink jet recording means for ejecting ink using thermal energy and is provided with electrothermal transducers for generating thermal energy. The recording head 2 eject the ink through the ejection outlet using pressure change resulting from expansion and contraction of bubbles generated by film boiling by the thermal energy supplied by the electrothermal transducers.

Figure 3:
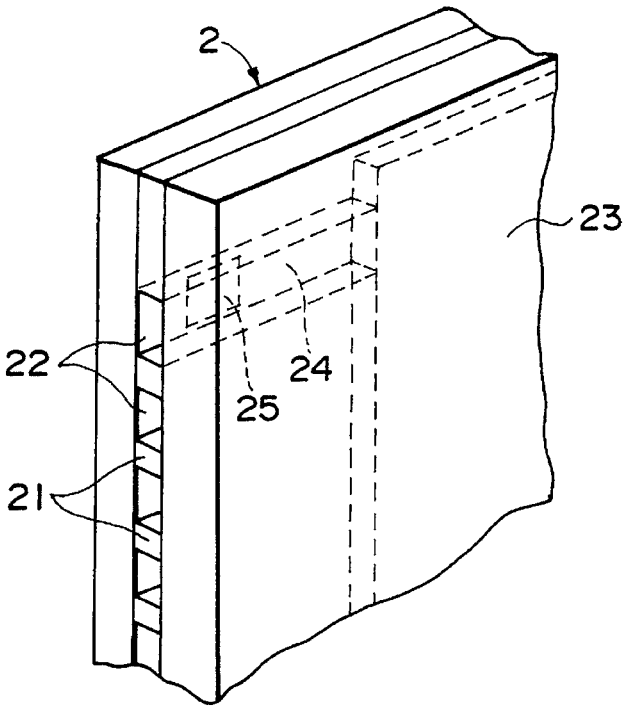
FIG. 3 is a partial perspective view illustrating a structure of the ink ejecting portion of the recording ink cartridge.

FIG. 3 is a partial perspective view schematically illustrating the structure of the ink ejection portion of the recording head. In this Figure, an ejection side surface 21 faced to the recording material 8 with a predetermined clearance (approx. 0.5–2.0, for example) therebetween is provided with a plurality of ejection outlets 22 arranged at predetermined intervals. Along walls of liquid passage 24 for communication between the common liquid chamber 23 and the ejection outlets 22, respectively, there are disposed electrothermal transducers (heat generating resistors) 25 for producing ink ejection energy. In this embodiment, the recording head 2 is mounted on the carriage 4 at such a positional relationship that the ejection outlets 22 are arranged in a direction transverse to the scanning direction of the carriage. With this structure, the electrothermal transducers 25 are driven (electric power supply) in accordance with the ejection signals or image signals, to create film boiling of the ink in the liquid passages 24, and the resultant pressure increase is used to eject the ink through the ejection outlets 22. Thus, the ejection outlets 22 are ink discharging portions.

When the ink is to be discharged to the outside as in ink ejection or recovery operation, the air is introduced into the ink container through the air vent 18 with the consumption of the ink. The ink distribution in ink container is such that the ink is concentrated to the neighborhood of the conduit for communication with the recording head, and correspondingly, air layer is formed adjacent the air vent.

When the ink is reloaded, if the air layer exist as it is, the proper ink passage to the recording head is not established even if the ink is supplied into the ink container or ink containing portion.

Therefore, it is required to reestablish the ink passage by recovery operation such as sucking operation or the like from the ejection outlets (nozzle) of the recording head. Otherwise, the refilled cartridge is not usable as it is.

Figure 4:
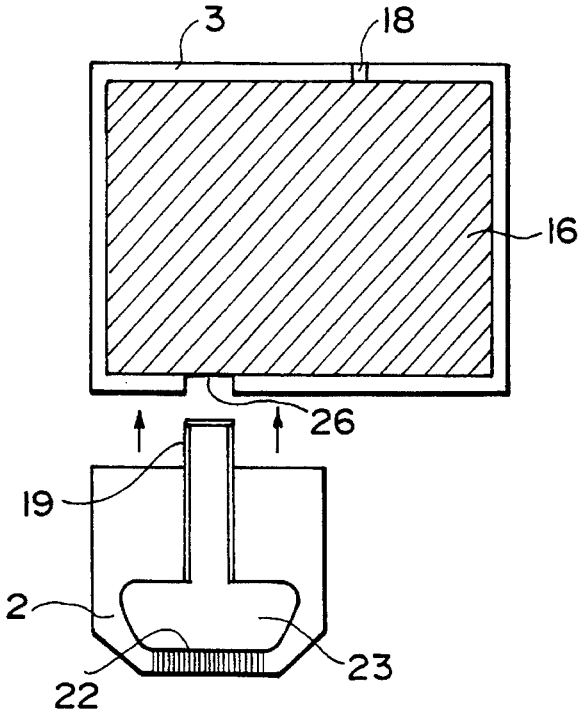
FIG. 4 is a schematic sectional view of an example of a recording ink cartridge which is different from that shown in FIG. 2.

FIG. 4 shows an ink cartridge in which the recording head portion and the ink containing portion are separable from each other, as different from the ink cartridge shown in FIG. 2. In the ink cartridge of this structure, an ink supplying portion 19 is projected from the recording head 2 in place of the ink conduit 17 in FIG. 2, and it is inserted into an ink supply port 26 formed in the ink container 3. The problem of the air layer described above arises adjacent the ink supply port 26 or ink supply portion 19 even in the separable type ink cartridge.

Figure 5:
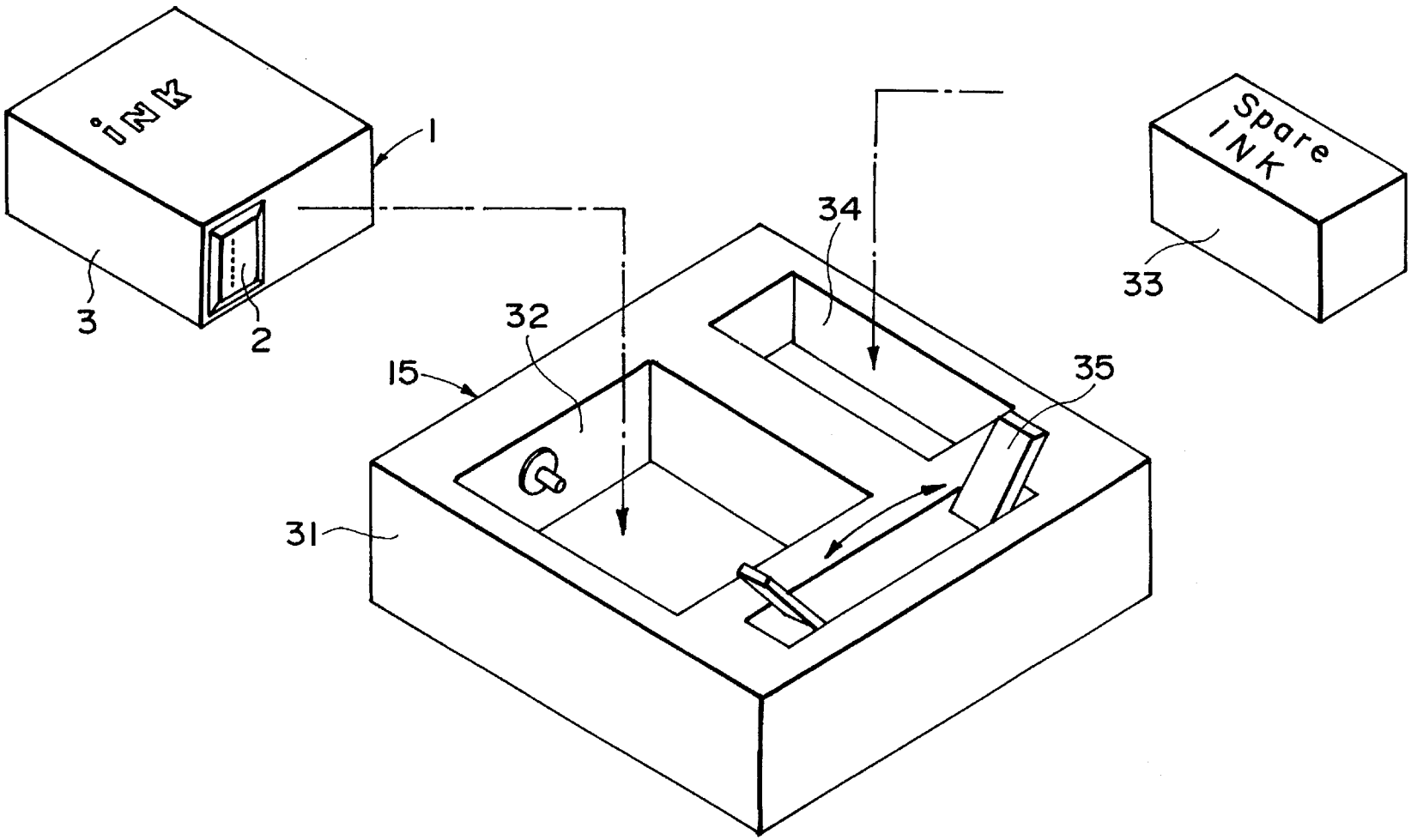
FIG. 5 is a schematic perspective view of an ink refilling apparatus for an ink jet recording apparatus according to a first embodiment of the present invention.

FIG. 5 is a schematic perspective view of an ink refilling apparatus 15 according to a first embodiment of the present invention. In this Figure, the main assembly 31 of the ink refilling apparatus 15 is provided with an opening (recess) 32 for retaining the recording ink cartridge, and an opening (recess) 34 for retaining a refilling ink cartridge 33. The recording ink jet cartridge 1 and the refilling ink cartridge 33 are mounted to the openings 32 and 34 or released therefrom by a setting lever 35.

The ink refilling or reloading apparatus of FIG. 4 may be disposed in the recording apparatus or may be separate from the recording apparatus, in accordance with the necessity or requirement.

In the separate structure, the refilling apparatus may have both of the recording ink cartridge and the refilling ink cartridge, or may have only one of them, or may have the ink refilling mechanism only, in accordance with the necessity or requirement.

When the recording ink jet cartridge becomes usable, the ink distribution in the ink container is such that a small amount of ink remains in the ink container, but there is no ink adjacent the conduit for communication between the recording head and the ink container, but there is air layer.

Figure 6:
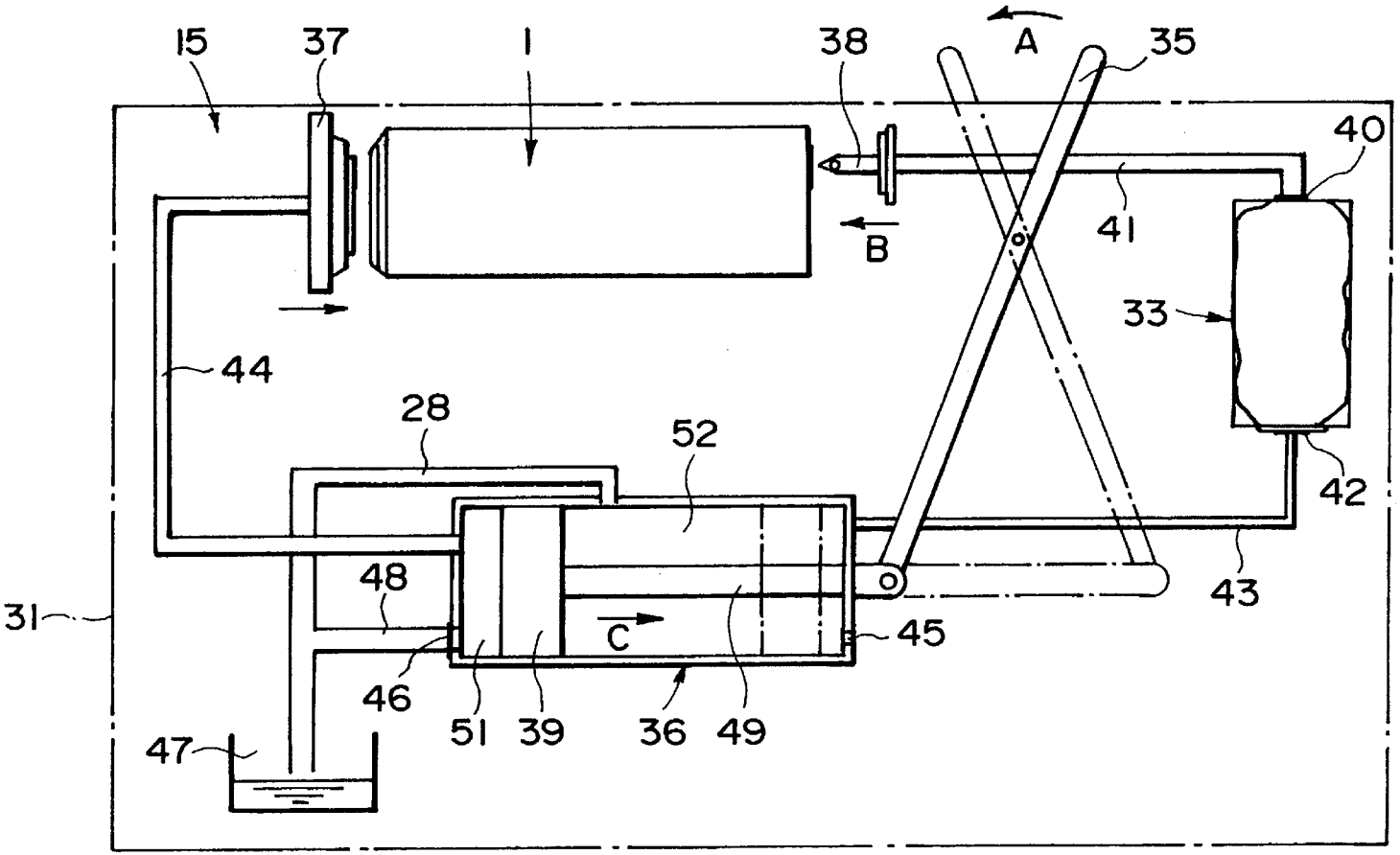
FIG. 6 is a schematic view illustrating system structure and operation of the ink refilling apparatus shown in FIG. 5.

FIG. 6 is a schematic view illustrating a system structure and operation of the ink refilling apparatus 15 according to the first embodiment. In FIG. 6, the main assembly 31 to which the recording ink cartridge 1 and the filling ink cartridge 33, is provided with a filling pump (pressure control device) 36 operable in synchronism with motion of the setting lever 35, a capping mechanism 37 for reducing pressure in the cap by the filling pump 36, and an injection joint 38 operable in synchronism with motion of the setting lever 35.

For the purpose of simplicity of the explanation of the operation, the ink extracting portion and the ink injecting portion of the container to be refilled are shown as being faced to each other. However, this structure is not limiting. Even if, the ink extracting portion and the ink injecting portion are provided in the same lateral side of the ink retaining container, for example, the same state as in FIG. 6 exists if the cutting line is selected to be along the ink passage connecting the ink extracting portion and the ink injecting portion.

Inside the filling pump 36, there is a slidably movable piston 39, which is interrelatedly connected with the setting lever 35 by way of a link mechanism including rod 49 or the like. The filling pump has a constant cross-sectional area in a direction perpendicular to the piston sliding direction. The capping mechanism 37 functions to establish the hermetical sealing by covering the ejection outlet 21 of the recording ink jet cartridge 1. The ink ejection joint portion 37 functions to connect the inside of the filling ink cartridge 33 and the inside of the ink container of the recording ink cartridge. When the filling apparatus is provided in the ink jet recording apparatus, a protection member (not shown) for protecting operator's fingers or the like is preferably provided around the ink refilling apparatus 15.

As described hereinbefore, the ink filling pump (pressure control device), is provided with the piston 39. Inside the ink filling pump, therefore, comprises a pressure controller 31 for controlling the pressure of the ink discharging portion and a pressure controller 52 for controlling the pressure of the air vent, that is, the ink pressure when the ink is pressure-injected through the air vent.

The pressure controller 51 is in the form of a vacuum generating chamber for sucking and reducing the pressure of the ink discharging portion covered with the cap 37. As for the mode of the pressure control operation, there is a pressure reducing mode in which the pressure of the inside of the ink container is reduced by sucking through the ink discharging portion, and a releasing mode for releasing the pressure reduction mode by stopping the sucking action by communication of the inside of the cap 37 with the ambience.

The pressure controller 52 is a pressure chamber for effecting pressure control upon injection of the ink through an injection joint 38 into the ink injecting portion (air vent). As for the pressure controlling mode, there are a mode in which the pressurizing chamber communicates with the ambience, thus not pressurizing the filling ink cartridge, and a pressurizing mode in which the filling ink cartridge is pressurized to pressure-inject the ink.

The description will be made as to the mechanism for transmitting the pressure of the pressure controller to the chip 37 and the injection joint 38.

As shown in FIG. 6, there is provided a joint portion 40 for connecting a conduit 41 having the ink injection joint 38 and an ink discharging portion of the filling ink cartridge 33 held on the main assembly 31 of the apparatus. Designated by a reference numeral 41 is a joint portion for connecting to the pressure supplying portion of the filling ink cartridge 33 the conduit 43 (pressure transmitting portion) from the pressurizing chamber of the filling pump 36. The capping mechanism 37 is connected with the vacuum generating side of the filling pump 36 through a conduit 44. At a pressurizing chamber end portion and a vacuum generating chamber end portion of the filling pump 36, there are provided check valves 45 and 46. In addition, an intermediate portion of the filling pump 36 is connected with a residual ink container 47 through a conduit 46. The vacuum generating chamber side end of the pump 36 is connected to the residual ink container 47 through the check valve 46 and the conduit 48.

Thus, with the volume change of the vacuum generating chamber, the ink or air adjacent the ink discharging portion of the recording ink jet cartridge 1 is sucked through the conduit 44.

On the other hand, with the volume change of the pressurizing chamber, the air therein is compressed, and the compressed air pushes the filling ink cartridge 33 through the conduit 43, so that the inside ink is pressurized and injected. With this structure, the filling pump 36 is capable of controlling the pressures of the ink discharging portion and the ink injecting portion by a single pressure controlling device, thus reducing the number of parts and simplifying the structure and reducing the size of the apparatus.

When a recording ink cartridge in which the recording head 2 and the ink container are separable from each other as shown in FIG. 4, in place of the above-described recording ink cartridge 1, only the ink container may be mounted to the opening 32 of the main assembly 31 of the ink filling apparatus. In this case, the capping mechanism 37 is used to establish the hermetical sealing by covering the ink supply port 26 (ink discharging portion) of the ink container. In the case of the ink filling for a separable recording ink jet cartridge, the ink refilling operation may be carried out while the recording head and the ink container are connected with each other, that is, similarly to the case of the integral type recording ink jet cartridge.

By operating the setting lever 35, driving force is provided through the link and cam mechanism from an unshown driving source (spring for example) or the setting lever, so that the capping mechanism 37 is pressed to the front surface of the ink cartridge 1 to provide the hermetically sealed state for the ejection side surface 21. Simultaneously therewith, an ink ejector (ink ejection joint) 38 is moved in the direction B to be inserted into the ink container 3 of the recording ink cartridge 1, by which the communicating state is established between the filling ink cartridge 33 and the ink container 3. In this case, the communication and sealing are established by the joint portion 40.

Since the operator moves the setting lever 35 in the direction A, the piston 39 connected through the link mechanism (rod 49 or the like), starts to move toward the upper dead point in the direction C. FIGS. 7–11 schematically show the operation of the piston 39 in the ink filling operation.

Referring to FIGS. 6, 7–11, the filling operation of the ink refilling apparatus 15 will be described.

Figure 7:
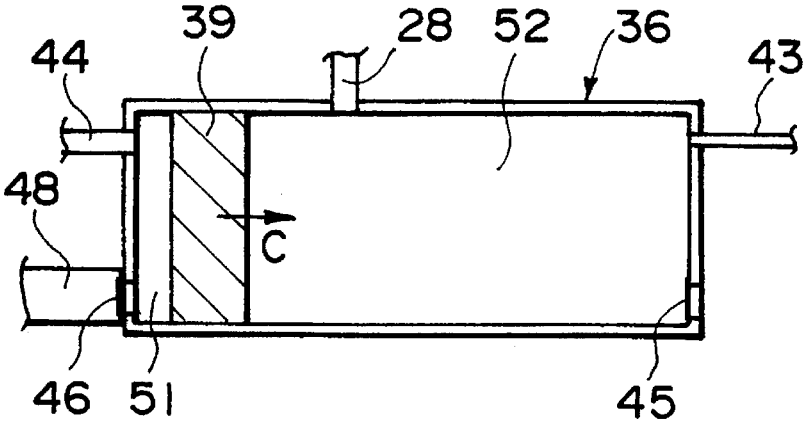
FIG. 7 is a schematic longitudinal sectional view when the refilling pump is in a standby state in the apparatus of FIG. 6.
Figure 8:
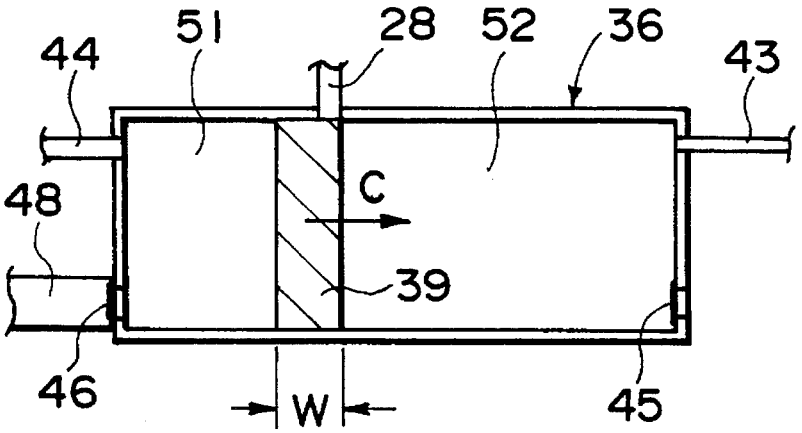
FIG. 8 is a schematic longitudinal sectional view in a state that the pressurizing action of the filling pump is started in FIG. 6.

FIG. 7 shows an initial waiting position. By movement of the setting lever 35, the piston 39 starts to move in the direction C toward the upper dead point. In the period of movement of the piston 39 from the position shown in FIG. 7 and the position shown in FIG. 8, the vacuum generating chamber (a chamber at a left hand side of the piston 39) 51 expands in a closed system, and therefore, the pressure in the vacuum generating chamber 51 reduces to a negative pressure. The vacuum acts on the capping mechanism 37 through the conduit 44, and the negative pressure is transmitted to the inside of the ink cartridge 1 through the ejection outlet 22, and the negative pressure is also transmitted to the inside of the ink container 3. Until the state of FIG. 8 is established, the pressurizing chamber 52 (the right side of the piston 39) of the filling pump 36 is in communication with the conduit 46 (air vent), the pressure of the pressurizing chamber 52 is not increased, but is maintained at the ambient pressure. Thus, in the above-described steps, a small amount of the ink enters the ink container by the vacuum inside the ink container, but a vacuum state (negative pressure) is established as a whole.

When the state of FIG. 8 is established, the conduit (air vent) 46 is closed by the piston 39, so that the vacuum is maintained in the vacuum generating chamber 51, and in the pressurizing chamber 52, a positive pressure starts to be produced. The negative pressure acts on the ejection outlets 22 of the recording head 2 through the conduit 44, and the positive pressure starts to act on the filling ink cartridge 33 through the conduit 43. Then, the ink bladder (not shown) in the filling ink cartridge 33 is collapsed by the positive pressure, by which the pressurized ink starts to flow out of the ink cartridge 33.

The inside of the ink container 3 of the recording ink cartridge 1 continues to be maintained at a negative pressure from the state FIG. 7, and therefore, it is possible to suck the ink remaining in the ink container 3 out. By continuing the sucking operation, the pressurized ink is injected into the ink absorbing material 16 in the ink container 3 placed generally under the negative pressure condition, by way of the conduit 41 and the injection joint 38. In this manner, the ink enters to the every corners of the ink absorbing material 16 in the ink container 3 more quickly than when the injection is effected after simple reduction or when only the pressurizing injection is effected.

The stroke of the simultaneously sucking and injection process, is adjustable by width W of the piston 39.

Figure 9:
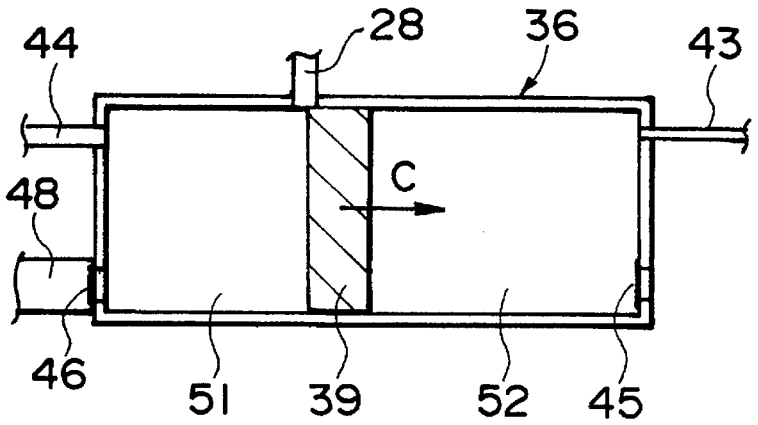
FIG. 9 is a schematic longitudinal sectional view in which the vacuum producing refilling pump is at rest in FIG. 6.
Figure 10:
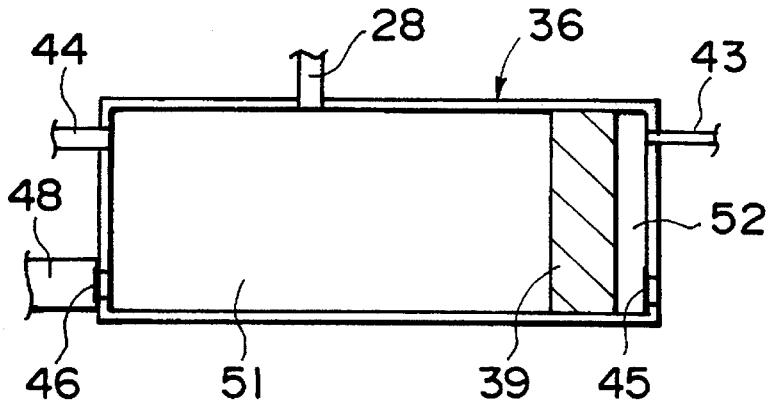
FIG. 10 is a schematic longitudinal sectional view in which the pressurizing action of the filling pump is carried out in FIG. 6.
Figure 11:
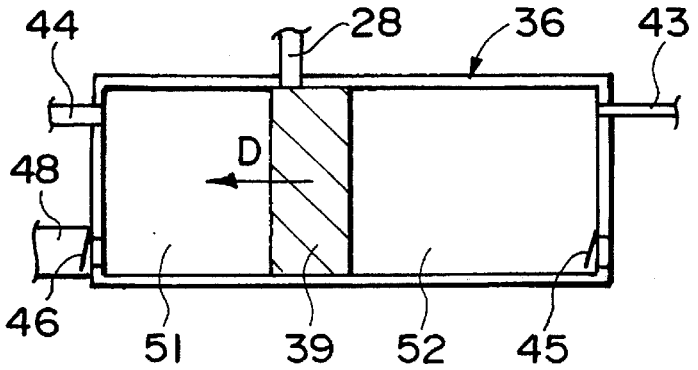
FIG. 11 is a schematic longitudinal sectional view in which a piston of the filling pump is in the returning stroke in FIG. 6.

When the piston 39 advances to the position shown in FIG. 9, the conduit 46 is opened to the vacuum generating chamber 51, so that the vacuum in the vacuum generating chamber 51 is removed to the original state (atmospheric pressure). Thereafter, as shown in FIG. 10, the piston 39 continues to move toward the top dead point in the direction C. During this period, the pressurizing chamber 52 continues to produce the positive pressure which continues to pressurize the filling injection cartridge 33 to continue the injection of the ink into the recording ink cartridge 1 (ink container 3). During this, the negative pressure of the vacuum generating chamber 51 is already removed, so that the ink sucking through the ejection outlets 22 of the recording head 2 is stopped, and therefore, the fresh (loaded) ink is not forcedly sucked out. Since the conduit 46 is open, the supply of the ink into the ink container 3 is not prevented.

Therefore, inside the filling pump 36, the motion of the piston 39 described in conjunction with FIGS. 7–10, performs the pressure control inside the ink container, ink discharging portion and ink injector in the ink refilling step, and simultaneously, the control of the ink supply quantity.

Thus, in this embodiment, the following three steps are carried out continuously.

As for the first step, the sucking operation is effected from the recording head side (ink discharging portion), and the pressure of the inside of the ink container is reduced without pressurized ink ejection through the air vent side (ink injecting portion).

In the second step, the pressurized ink is injected from the air vent side into the ink container having the pressure reduced in the first step, and simultaneously, the sucking action occurs at the nozzle side of the recording head, and therefore, the pressure reduced state is maintained as a whole, to permit the injection of the ink.

The quantity of the ink supplied at this time, can be controlled by adjusting the width W of the piston such that the ink reaches to the ink discharging portion or to the neighborhood thereof. Since the inside of the ink container is maintained in a certain degree of vacuum, the ink spreads all over the inside of the ink container.

In the third step, in this embodiment, the sucking of the nozzle side of the recording head (ink discharging portion) is stopped to permit communication with the ambience, and thereafter, the pressurized ink is injected through the air vent (ink injecting portion). The above-described first, second and third steps are accomplished since the filling pump 36 has the following three modes.

In the first mode, the negative pressure is established in the vacuum generating chamber by the volume change, and on the other hand, the pressurizing chamber is in communication with the ambience.

In the second mode continuous to the first mode, the pressure of the pressurizing chamber is increased while reducing the pressure of the vacuum generating chamber with substantially the same volume changing ratios of the vacuum generating chamber and the pressurizing chamber in the absolute value but in the opposite polarities.

In the third mode continuous to the second mode, the vacuum generating chamber is in communication with the ambience to remove the vacuum state, and on the other hand, the pressure of the pressurizing chamber is increased.

By such three modes, the above-described operation is possible.

By doing so, the ink can spread in the ink container, and the ink can be supplied to the normal position even if the ink in the recording head is introduced into the ink container by the vacuum of the ink container.

Since the ink is pressurized and injected without sucking, the pressure reduced state in the ink container gradually approaches to the ambient pressure, and therefore, the ink hardly leaks out through the nozzle of the recording head.

Therefore, by continuously performing the first, second and third steps described in the foregoing, a constant amount of the ink can be supplied to every corners of the inside of the ink container, and the ink flow passage can be assuredly established between the recording head and the inside of the ink container. Therefore, the ink in the filling ink cartridge can be effectively used. Additionally, when the recording ink jet cartridge is remounted after the refilling, the recording operation is possible without ink leakage.

By moving the piston 39 to the position indicated in FIG. 10 to refill the ink, and thereafter, the setting lever 35 is moved to the releasing position. Then, the moving direction of the piston 39 is reversed. As shown in FIG. 10, the check valves 45 and 46 are opened. The piston 39 moves in the direction indicated by an arrow D toward the original position (waiting) position. At this time, the residual ink flowed into the vacuum generating chamber 51 is discharged to the residual ink container 47 outside the cylinder through the conduit 48. According to this ink refilling operation, after the residual ink is forcedly discharged by time deviation between the vacuum and the positive pressure, the pressurized ink is injected into the ink container placed generally under the vacuum condition, and therefore, the filling efficiency is significantly improved. In addition, the leakage of the ink can be prevented, and in addition, the ink can be loaded with simple operation while preventing contamination of the parts around it is prevented.

In the foregoing embodiment, as shown in FIG. 6, the setting lever 35 directly connected is used has a driving means for moving the piston 39. In place thereof, a structure for transmitting to the piston 39 with delay the operating force applied to the link mechanism, is usable. In addition, the driving force in this case may be accumulated in an energy accumulating means such as spiral spring or fly wheel or the like. Additionally, as for the driving source, a motor, plunger or another driving source is usable. Alternatively, the operation of the setting lever 35 may be started with trigger. Further alternatively, the filling operation can be carried out in response to a starting switch or the like.

Figure 12:
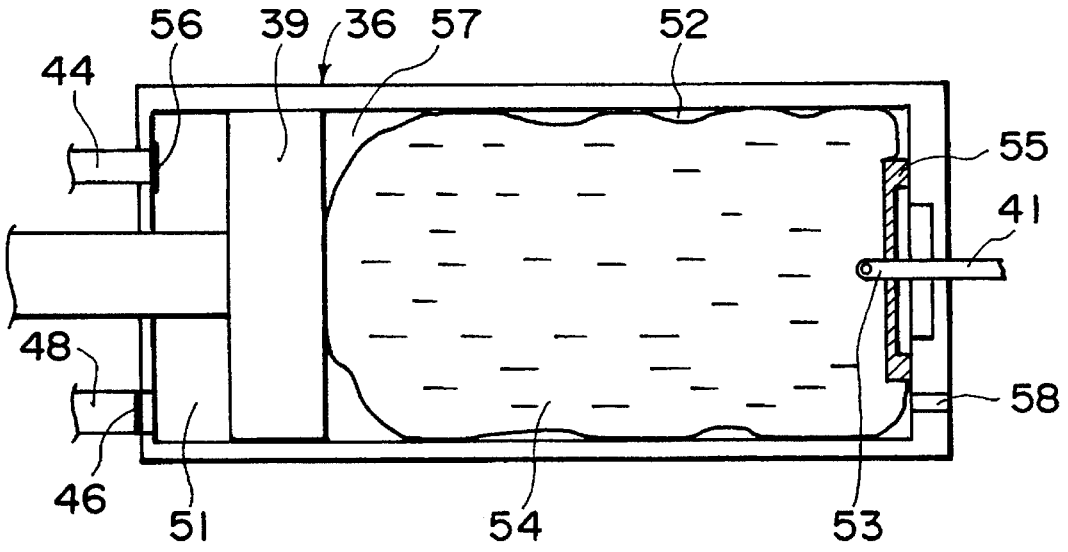
FIG. 12 is a schematic longitudinal sectional view of the major parts of the ink refilling apparatus according to a second embodiment of the present invention, which the apparatus is at rest.
Figure 13:
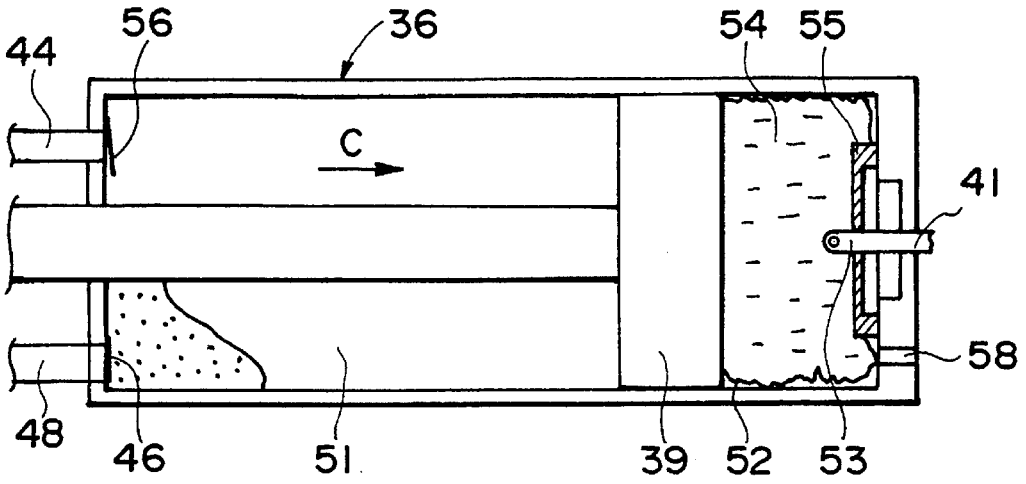
FIG. 13 is a schematic longitudinal sectional view of the ink refilling apparatus of FIG. 12 in which the pressurizing operation is effected.
Figure 14:
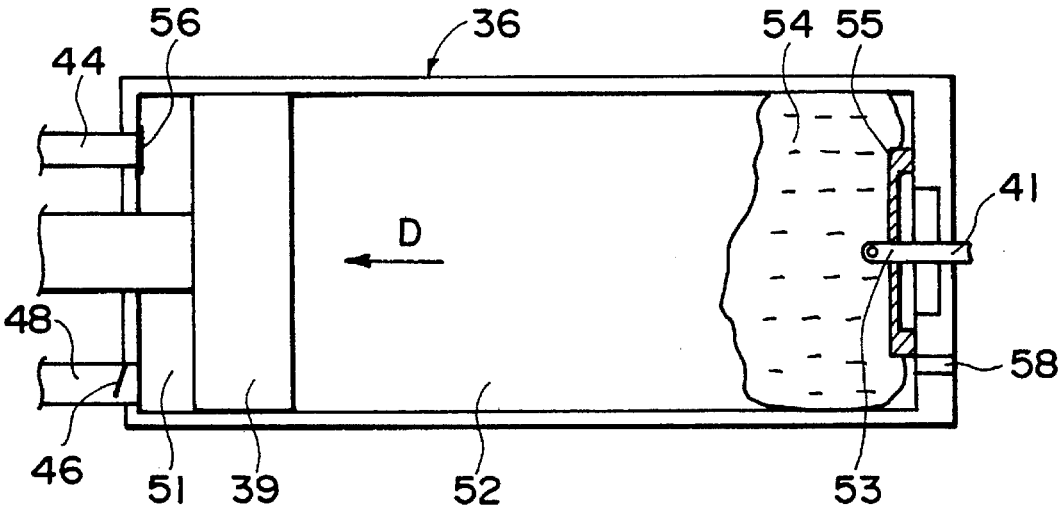
FIG. 14 is a schematic longitudinal sectional view of the ink refilling apparatus of FIG. 12, in which the piston is in the returning stroke.

Referring to FIGS. 12, 13 and 14, there is shown an ink refilling apparatus 15 according to a second embodiment of the present invention. In this embodiment, the filling ink cartridge 33 and a filling pump 36, as in the first embodiment (FIG. 6), are unified.

According to this embodiment, the unification permits size reduction of the ink filling apparatus. However, it does not involve the step corresponding to the third step in the first embodiment. Therefore, the quantity of the ink sufficient to reach the ink discharging portion is injected upon the completion of the pressurizing injection of the ink with the pressure reduction of the inside of the ink container. FIG. 12 shows the waiting state before the filling action. FIG. 13 shows the state in which the piston 39 is moved almost to the top dead point in the direction indicated by an arrow C. FIG. 14 shows the state in which the piston 39 is reversed and moved from the state shown in FIG. 13 in the direction D to the original position.

In FIG. 12, the filling pump 36 of this embodiment has an opening and closing function by a part (phantom lines in FIG. 12) of the ink bladder pressurizing chamber 52 in the cylinder of the filling pump 36. The flexible ink bladder 54 corresponds to the filling ink cartridge 33 in FIG. 5. In this embodiment, between the vacuum generating chamber 51 and the conduit 44 communicating with the capping mechanism 37 (FIG. 6), there is provided a check valve 56 permitting negative pressure transmission only to the capping mechanism 37. In this embodiment, when the ink bladder 54 is inserted (FIG. 12), a space 57 is provided between the pressurizing chamber 52 and the ink bladder 54. In order to permit the deformation of the ink bladder 54, an opening 58 for permitting external communication of the inside of the pressurizing chamber is provided in a wall facing to the piston.

In use, the ink bladder 54 is inserted into the pressurizing chamber 52. The conduit 51 connected to the recording ink cartridge 1 (FIG. 6) is connected with the ink bladder 54 through the joint 55 provided at an end of the pressurizing chamber 52. Thereafter, the opening is closed. Then, by operating the lever (the setting lever 35 or the like in FIG. 6), the piston 39 is moved in the direction C toward the top dead point. Thus, as shown in FIG. 12, the ink is directly pressurized and pushed out into the recording ink cartridge 1. After the ink injection, the lever is manipulated, so that the piston 39 is reversed in the direction D as shown in FIG. 14 to the original position.

In this embodiment, the piston 39 functions as the pressure transmitting portion to the filling ink cartridge.

The second embodiment shown in FIGS. 12, 13 and 14, is different from the first embodiment shown in FIG. 6 in the above-described respects. In the other respects, they are substantially the same, and therefore, the detailed description thereof are omitted for simplicity by assigning the same reference numerals to the corresponding elements. This embodiment provides the similar advantageous effects as the first embodiment using the first and second steps. The reason for this is that the space 58 between the pressurizing chamber 52 and the ink bladder 54 functions as a buffer, so that the time difference between the negative pressure and the positive pressure can be assured.

According to this embodiment, an opening 34 for retaining the filling ink cartridge 33 in FIG. 5 and the joint portion 42 and the ink conduit 43 in FIG. 6, can be omitted. Therefore, the size of the ink refilling apparatus 15 can be further reduced. The reduction of the number of joints can improve the reliability of the apparatus in addition to the cost reduction. In addition, since the ink bladder 54 is directly collapsed, the filling efficiency can be further increased without difficulty.

However, the first embodiment is advantageous over this embodiment in the uniformity of the ink distribution when the ink is reloaded.

Figure 15:
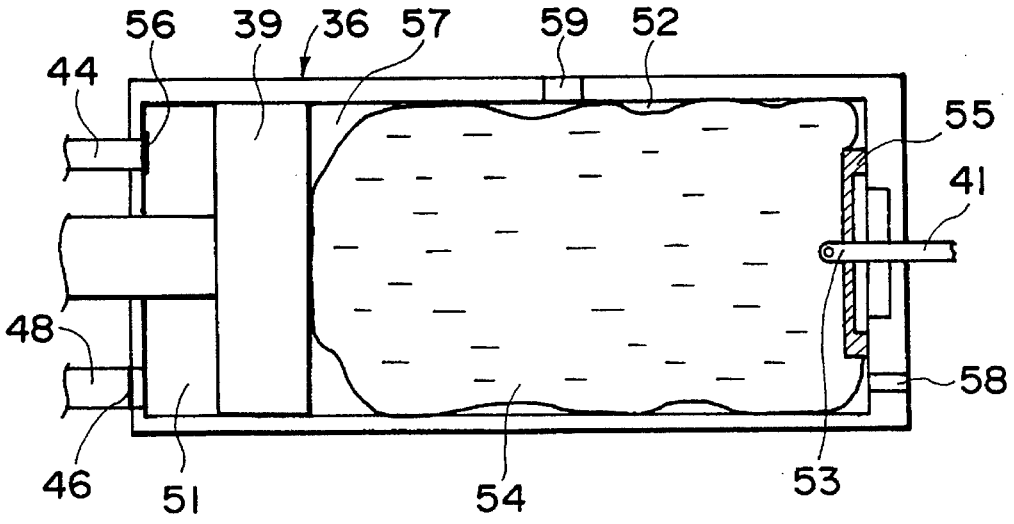
FIG. 15 is a schematic sectional view of an ink filling apparatus according to a third embodiment of the present invention in which the apparatus is in a stand-by state.
Figure 16:
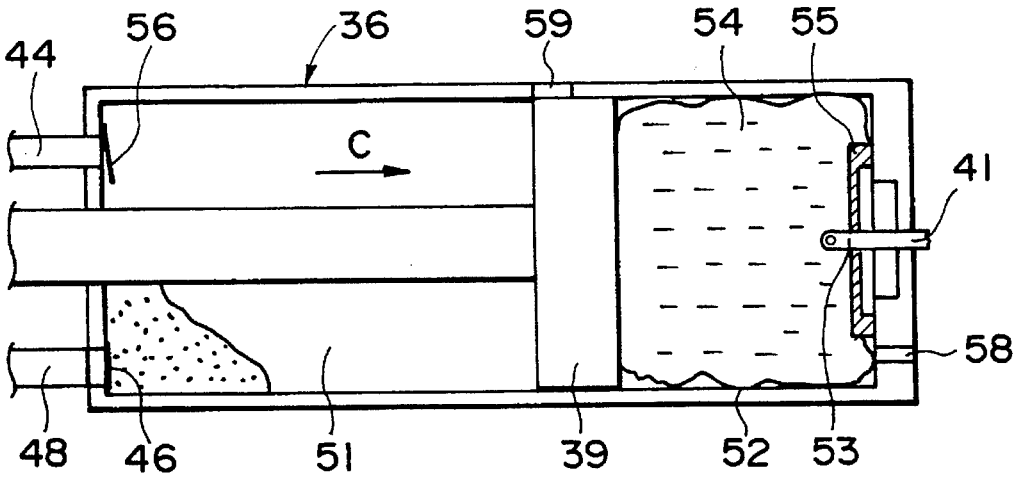
FIG. 16 is a schematic sectional view of the ink refilling apparatus of FIG. 15 in which the sucking operation from the chip is being completed.

Referring to FIGS. 15 and 16, a third embodiment of this invention will be described, which is a modification of the above-described second embodiment by adding the capability of pressurized injection of the ink without sucking the ink from the recording head.

For this purpose, there is provided an opening 59 for communicating the inside and outside of the vacuum generating chamber 51. In this Figure, the same reference numerals as in the second embodiment are assigned to the element having the corresponding functions, and the detailed description thereof are omitted for simplicity.

In this embodiment, the provision of the opening 59 adds the step which is similar to the third step in the first embodiment, but it is still different from the first embodiment in the following.

FIG. 16 shows the state immediately before the vacuum condition of the vacuum generating chamber is shifted to the atmospheric condition. After this, the piston moves in the direction C, permitting introduction of the air through the opening 59, with the result of the atmospheric pressure in the vacuum generating chamber 51. At this time, the valve 56 is closed to prevent the further sucking from the cap side. In this embodiment, the injected ink reaches to the ink container side opening of the conduit for communication between the ink container and the recording head or to the neighborhood thereof.

Accordingly, the ink is pressurized and injected without the sucking from the cap side, and therefore, the pressure of the cap side is close to the atmospheric pressure with the injection of the ink. At this time, depending on the total volume of the cap side to the valve 56, a small quantity of the ink leaks through the nozzle or nozzles. In this respect, the first embodiment is more advantageous than this embodiment. Since, however, it has the step of pressurizing and injecting the ink without sucking from the ink discharging portion, the ink spreads to every corners in the ink container, and the communication between the recording head and the ink container is assured upon the end of the filling operation.

Figure 17:
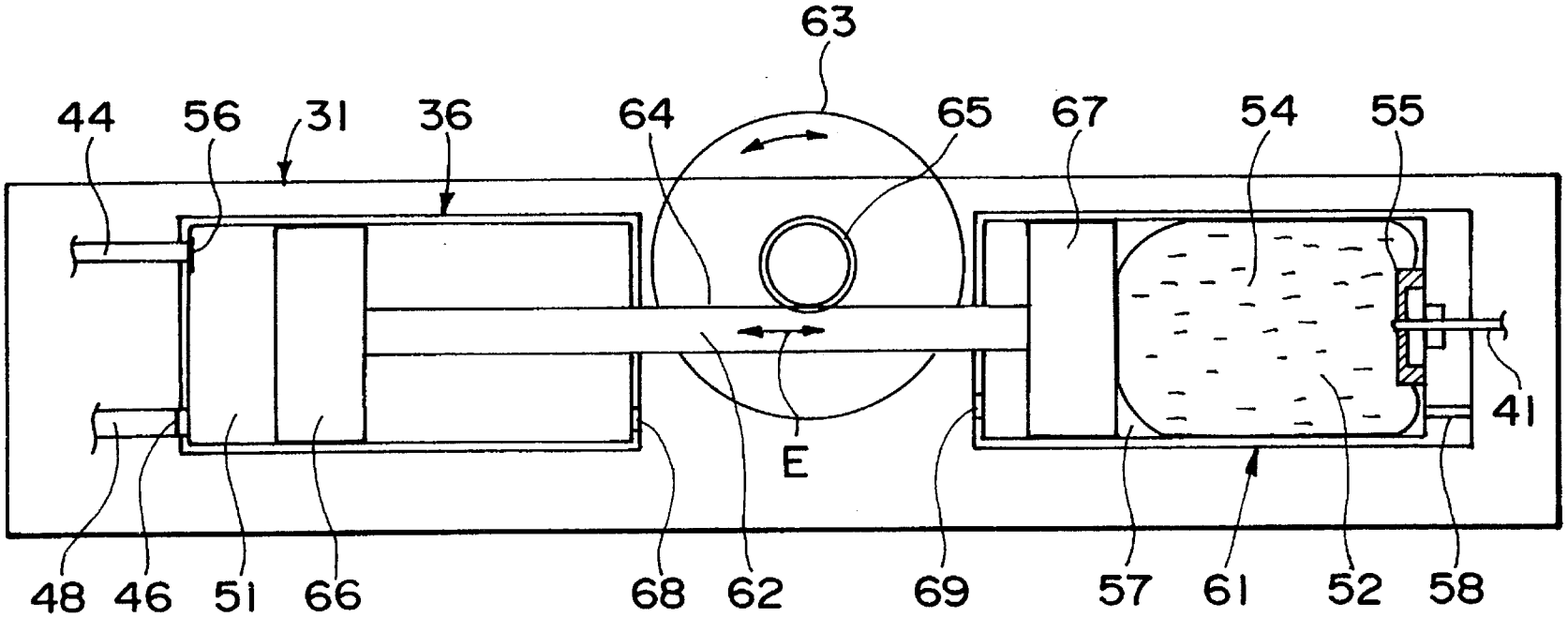
FIG. 17 is a schematic longitudinal sectional view of an ink refilling apparatus according to a fourth embodiment of the present invention in which the apparatus is in a stand-by state.

FIG. 17 is a schematic longitudinal sectional view of an ink refilling apparatus 15 according to a fourth embodiment of the present invention. According to this embodiment, similarly to the second embodiment, the setting lever 35 in the first embodiment shown in FIG. 6, is not used so that the size of the apparatus is further reduced. In this embodiment, the filling pump 36 and the filling ink container 61 are connected by piston shaft 62, and the piston shaft 62 is moved in the double headed arrow E directions by a rack-pinion mechanisms 64 and 65 provided between the operating knob 63 and the piston shaft 62. With the structure of FIG. 17, the ink refilling apparatus 15 is small and thin.

In the fourth embodiment shown in FIG. 17, the piston 66 for the filling pump 36 and the piston 67 for the filling ink container 61 are provided at the opposite ends of the piston shaft 62. The vacuum generating chamber 51 is formed in the filling pump 36, and the pressurizing chamber 52 is formed in the filling ink container 61. In the pressurizing chamber 52, a flexible ink bladder 54 is inserted. Between the ink bladder 54 and the pressurizing chamber 52, said space 57 for the buffering function is provided. A chamber at the right side of the filling pump 36 is in communication with the ambience through the opening 68, and the chamber at the left side of the filling ink container 61 is in communication with the ambience through an opening 69.

The fourth embodiment shown in FIG. 17 is different from the first embodiment shown in FIG. 6, the second embodiment shown in FIG. 12 and the third embodiment of FIG. 16, in the above-described respects. As for the other respects, they are substantially the same, and therefore, the detailed description thereof are omitted for simplicity by assigning the same reference numerals to the elements having the corresponding functions. The embodiments of FIG. 17 provides the same advantageous effects as in the first and second steps of the first embodiment and the second embodiment. As for a modification of the structure of FIG. 17, the rotational motion of the knob 63 and the capping mechanism 37 (FIG. 6) or the like may be interrelatedly operated. The capping mechanism 37 or the like may be operated by motor or another driving source. Furthermore, as to the capping mechanism 37 and the various joint portions, the structures may be such that the hermetical sealing is automatically established upon insertion of the recording ink cartridge 1 into the opening 32 (FIG. 5) using charged spring energy. In other words, the filling operation may be automatically carried out after detection of the mounting of the recording ink cartridge 1 to the ink refilling apparatus 15.

Figure 18:
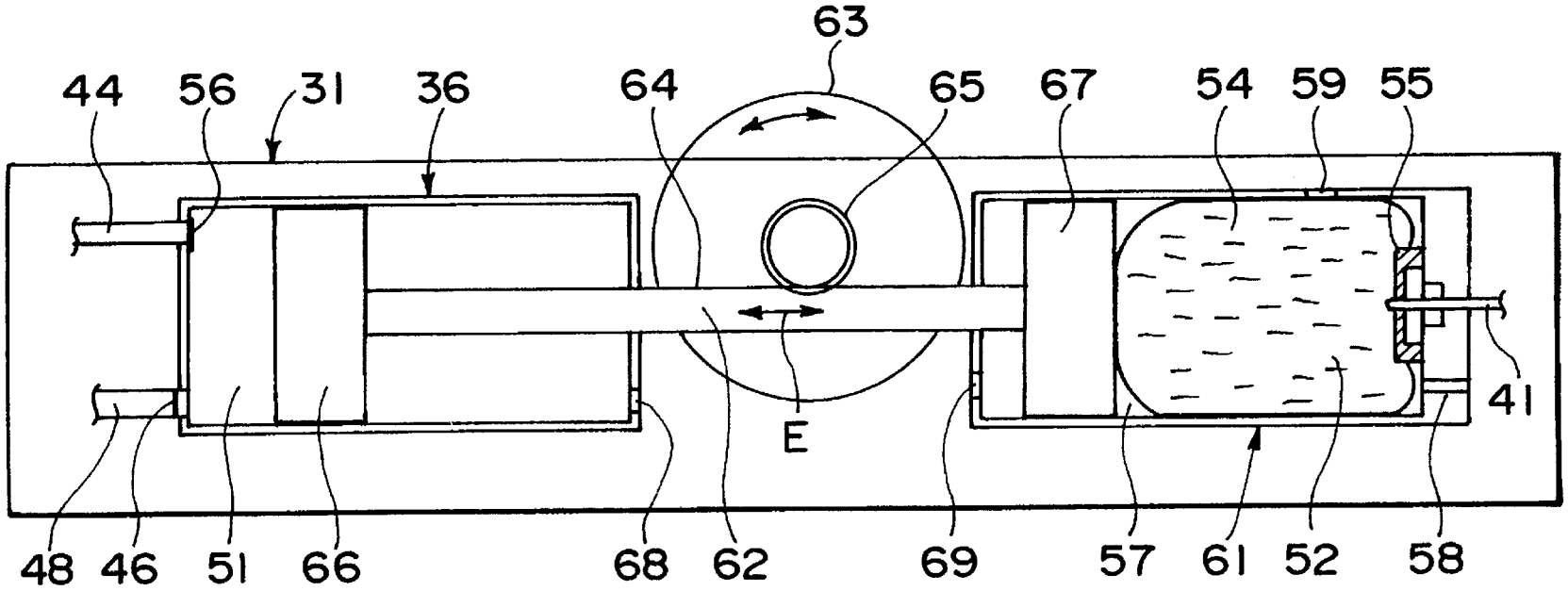
FIG. 18 is a schematic sectional view of an ink refilling apparatus according to a fifth embodiment of the present invention in which the apparatus is in the stand-by state.

FIG. 18 shows a fifth embodiment which is a modification of the above-described fourth embodiment, which is provided with a step permitting pressurized ink injection without sucking from the recording head side, that is, ink discharging portion. What is different from the fourth embodiment is in that the pressurizing chamber 52 is provided with an opening 59. In the other respects, the structures are the same as in the fourth embodiment. Therefore, the detailed description thereof are omitted for simplicity by assigning the same reference numerals to the elements having the corresponding functions. The opening in this embodiment has the same function as that of the opening 59 in the third embodiment. Therefore, a larger quantity of the ink can be reloaded into the inside of the ink to the corners thereof than the fourth embodiment.

The fourth and fifth embodiments are advantageous over the first, second and third embodiments from the standpoint of small size of the apparatus. However, from the standpoint of the ink distribution after the ink filling, the first, third and fifth embodiments are advantageous over the fourth embodiment.

Additionally, similarly to the third embodiment, the fifth embodiment involves the possibility of slight quantity of the ink leakage in the step corresponding to the third step of the first embodiment. For this reason, from the standpoint of the use efficiency of the refilling ink, the first embodiment is preferable.

Figure 19:
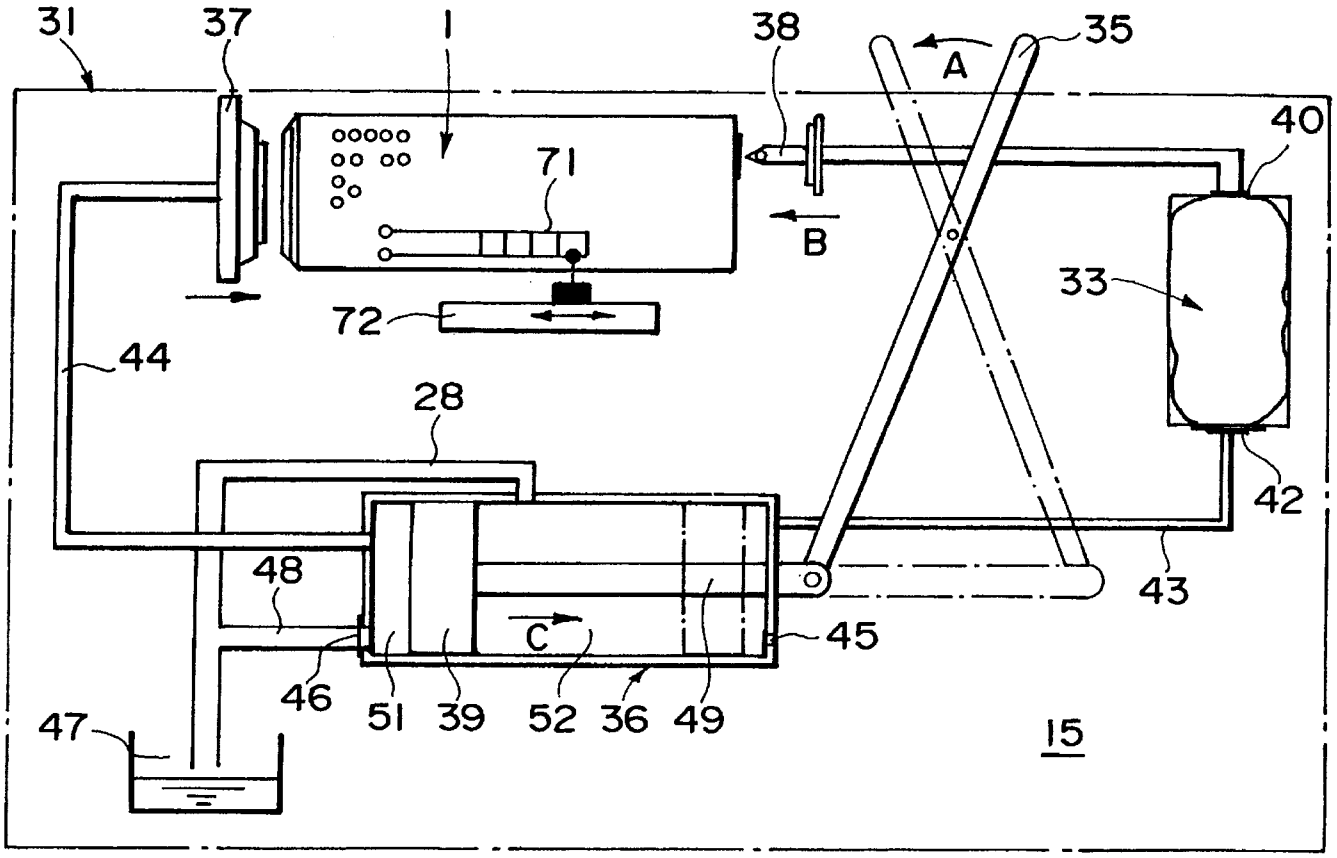
FIG. 19 schematically illustrates a system structure and operation of an ink refilling apparatus according to a sixth embodiment of the present invention.

FIG. 19 illustrates the system structure and the operation of an ink refilling apparatus 15 according to a sixth embodiment of the present invention. In this embodiment, in addition to the structure of the first embodiment shown in FIG. 6, there is provided a structure for providing identification marking with the recording ink cartridge 1. The marking carries the history of the refilling. The marking is added every filling operations. By doing so, the user is notified with the arrival of the limit of the service life of the part. In FIG. 19, the same reference numerals as in FIG. 6 are assigned to the elements having the corresponding functions, and the detailed description thereof are omitted for simplicity.

In FIG. 19, a pattern (detection pattern) for recording 71 is provided to a part of the recording ink cartridge 1, and by detecting the resistance of the pattern 71, the number of the filling operations is known. If the number is not more than a predetermined number, a part of the pattern 71 is changed by a pattern changing mechanism 72 (by cutting a part, for example). Thereafter, the ink filling operation is carried out. Alternatively, by reading an inherent identification (Serial No., for example) or the like of the recording ink cartridge 1, the history of the refilling operations may be stored in the main apparatus. Then, the stored information and the service life number may be compared so that the discrimination is made as to whether or not the number of the filling operations is not more than the predetermined number or not (whether the service life is reached or not). As an alternative, used a plurality of recording ink cartridges may be contained in a magazine, and the ink may be injected continuously into the cartridges in response to detections of emptiness thereof, and the operation continues until all the magazine have been processed.

Figure 20:
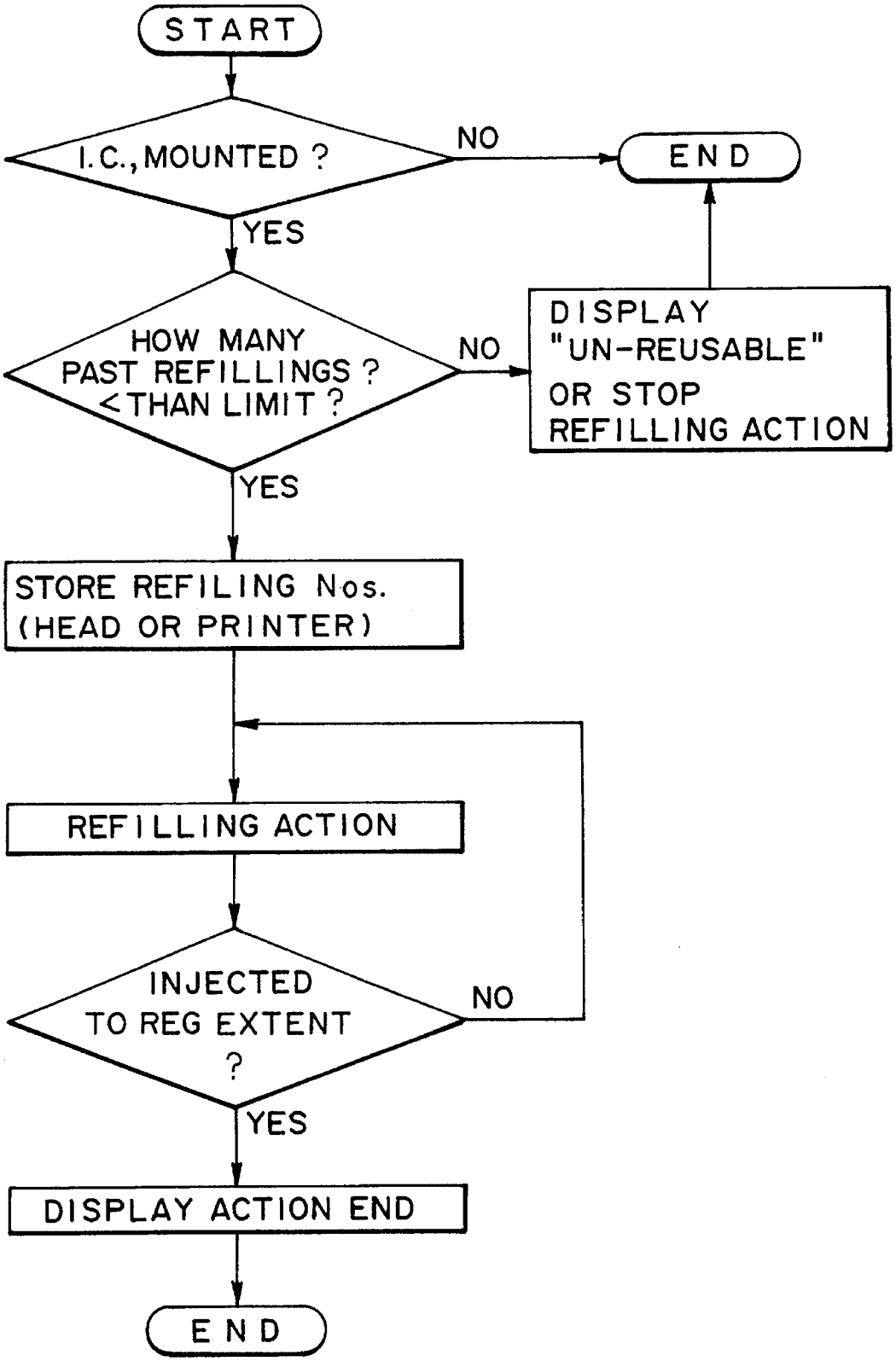
FIG. 20 is a flow chart illustrating control operations in the apparatus of the sixth embodiment.

FIG. 20 is a flow chart of the steps of the detection mechanism described above.

In the sixth embodiment shown in FIG. 19, the following structures are used in addition to the structures of the first embodiment shown in FIG. 6: the structure for effecting the filling operation after detection of the mounting of the recording ink cartridge 1; the structure for marking the recording ink cartridge 1 with identification mark for every refilling actions: the structure for storing the history of the refilling operations by checking the serial number or the like of the recording ink cartridge 1 to be refilled; the structure for displaying the even that the recording ink cartridge 1 is going to be used beyond it service life; or the structure for detecting the number of refilling operations of the recording ink cartridge 1 and for displaying the event that the recording ink cartridge 1 is going to be used beyond the service life thereof. By the addition of such structures, the recording ink cartridge 1 can be sufficiently used up to the service life thereof by refilling it, while maintaining the reliability of the recording apparatus. Therefore, the economical ink refilling apparatus 15 for the ink jet recording apparatus can be provided.

In the foregoing description, a replaceable recording ink cartridge 1 has been described which is in the form of a unified ink container 3 and recording head 1. However, this is an example, and the present invention is applicable with the same advantageous effects to an ink cartridge containing only ink container as the replaceable recording ink cartridge, without the recording head portion.

With the foregoing embodiments, the description has been made with respect to a serial type recording apparatus for carrying the recording head (recording ink cartridge) on a carriage. However, the present invention is applicable to a line type recording head covering the entire width or a substantial part thereof, with the same advantageous effects. In the foregoing embodiments, one recording head (recording ink cartridge) is used. However, the present invention is usable for a color ink jet apparatus using a plurality of recording heads effecting the recording with different colors, or for an ink jet recording apparatus capable of tone printing using a plurality of recording heads providing different tone levels in the same color. That is, the present invention is usable irrespective of colors and numbers of the recording heads with the same advantageous effects.

The present invention is usable with any ink jet apparatus, such as those using electromechanical converter such as piezoelectric element, but is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals.

By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

As will be understood from the foregoing, according to the present invention, there is provided an ink refilling apparatus in which after the negative pressure is generated in the ink ejection surface or ink discharging portion of the recording ink cartridge, the pressurized ink is injected into the recording cartridge, and therefore, the ink refilling or reloading to the ink cartridge can be carried out with compact structure, without difficulty, with high efficiency, without contamination of the operator's fingers or the like and in a short period.

According to various aspects of the present invention, the following structure may be used: the structure having a supporting portion for supporting the recording ink cartridge and a filling ink cartridge, and the filling pump; the structure for carrying out a series of operations in the ink refilling process by a setting lever; the structure for effecting the filling operation after detection of the recording ink cartridge mounting; the structure for marking the recording ink cartridge with discrimination mark for every refilling operations; the structure in which the serial number or the like of the recording ink cartridge to be refilled is investigated, and the history of the refilling operations is stored, and the arrival of the service life of the recording ink cartridge is displayed; or the structure in which the number of refilling operations of the recording ink cartridge is detected, and the display is made if the recording ink cartridge is used beyond it service life. Therefore, the ink refilling to the ink cartridge can be more efficiently carried out with compact structure, without difficulty, with high efficiency, without contamination of the operator's fingers or the like and in a short period.

According to another aspect of the present invention, there is provided an ink jet recording apparatus for effecting the recording by ejecting ink from the recording means to the recording material, wherein after the vacuum is generated in the ejection side surface or in the ink discharging portion of the recording ink cartridge, the pressurized ink is injected into the recording ink cartridge, and therefore, the refilling of the ink to the ink cartridge can be carried out with compact structure, without difficulty, with high efficiency, without contamination of operator's fingers and in a short period.

In further various aspects of the present invention, the following structures are usable: the structure having a supporting portion for supporting the recording ink cartridge and the filling ink cartridge, and the filling pump; the structure for carrying out a series of operations in the ink refilling operation by using the setting lever in the ink refilling apparatus; the structure for effecting the filling operation after detection of the recording ink cartridge mounting in the ink refilling apparatus; the structure for marking the recording ink cartridge with discrimination mark for every refilling operations of the ink refilling apparatus; the structure of the ink refilling apparatus in which the serial number or the like of the recording ink cartridge to be refilled is investigated, and the history of the refilling operations is stored, and the service life thereof is displayed if the recording ink cartridge is going to be used beyond it; the structure of the ink refilling apparatus in which the number of refilling operations of the recording ink cartridge is detected, and if the recording ink cartridge is going to be used beyond it service life, the event is displayed. Therefore, the ink refilling operations of the ink cartridge can be carried out more efficiently with compact structure, without difficulty, with high efficiency, without contamination of the operators fingers or the like and in short period.

Furthermore, using the present invention, when the ink refilling step is completed, the ink flow passage is assuredly established between the recording head and the ink container without existence of the air layer or the like, so that the ink flow is not blocked. Accordingly, the ink cartridge is usable immediately after the filling operation.

The use efficiency of the ink refilling cartridge can be increased, and the time required for refilling the cartridge can be shortened with the advantageous of the small size and the simple structure of the apparatus.

Thus, high quality printing can be assured with the refilled ink cartridge.

While the invention has been described with reference to the structures disclosed herein, it is not confined to the details set forth and this application is intended to cover such modifications or changes as may come within the purposes of the improvements or the scope of the following claims.

What is claimed is:

1. An ink refilling apparatus for loading ink into a recording ink cartridge having an ink discharging outlet, and an air vent for communication with ambience, comprising:

a filling ink cartridge for containing ink to be used for refilling the recording ink cartridge;

pressure control means having a first pressure controlling portion for controlling a pressure of the ink outlet and a second pressure controlling portion for controlling a pressure of the air vent; and pressure transmitting means for transmitting a pressure variation of said second pressure controlling portion to said filling ink cartridge;

wherein said apparatus operates in a first mode in which only said first pressure controlling portion is controlled to reduce a pressure in said first pressure controlling portion, a second mode in which the pressure in said first pressure controlling portion is reduced, and substantially simultaneously, a pressure of said second pressure controlling portion is increased, and a third mode in which only said second pressure controlling portion is controlled, and a pressure of said second pressure controlling portion is increased.

2. An apparatus according to claim 1, further comprising storing means for storing information inherent to said recording ink cartridge, and another storing means for storing a number of ink refilling operations having been carried out to said recording ink cartridge.

3. An ink jet recording apparatus having recording means for effecting recording by ejecting ink from a recording ink cartridge having an ink discharging portion and an air vent to a recording material, comprising:

means for imparting relative movement between the recording means and the recording material;

recovering means for recovering operation of the recording means;

a filling ink cartridge containing ink to be loaded into the recording ink cartridge;

pressure control means having a first pressure controlling portion for controlling a pressure of the ink discharging portion and a second pressure controlling portion for controlling a pressure of the air vent; and pressure transmitting means for transmitting a pressure variation of said pressure controlling portion to said filling ink cartridge;

wherein said apparatus operates in a first mode in which only said first pressure controlling portion is controlled to reduce a pressure in said first pressure controlling portion, a second mode in which the pressure in said first pressure controlling portion is reduced, and substantially simultaneously, a pressure of said second pressure controlling portion is increased, and a third mode in which only said second pressure controlling portion is controlled, and a pressure of said second pressure controlling portion is increased.

4. An apparatus according to claim 3, further comprising storing means for storing information inherent to said recording ink cartridge, and another storing means for storing a number of ink refilling operations having been carried out to said recording ink cartridge.

5. An ink refilling method for refilling an ink cartridge having an ink container provided with an ink discharging outlet and an air vent for communication with ambience, comprising:

a first step of establishing a pressure reduced state in said ink container by sucking air from inside of said ink container through the ink outlet with the air vent closed;

a second step, continuous to said first step, of pressurizing and injecting ink through said air vent while sucking air from inside of said ink container through the ink outlet; and a third step, continuous to said second step, of pressurizing and injecting ink through the air vent after said sucking is stopped.

* * * * *

UNITED STATES PATENT AND TRADEMARK OFFICE

CERTIFICATE OF CORRECTION

PATENT NO. : 5,504,510

DATED : April 2, 1996

INVENTOR : AKIRA MIYAKAWA

It is certified that error appears in the above-identified patent and that said Letters Patent is hereby corrected as shown below:

ON THE TITLE PAGE

[57] ABSTRACT

Line 8, "pressure a transmitter" should read --a pressure transmitter--.

IN THE DRAWINGS

Sheet 13 of 13, FIG. 20, "REFILING" should read --REFILLING--.

COLUMN 1

Line 67, "tageous" should read --tages--.

COLUMN 2

Line 24, "and" should read --an--;
Line 33, "increase" should read --increasing--.

COLUMN 3

Line 32, "supplied" should read --supply--;
Line 33, "entirely of the ink retainer" should read --entirety of the ink container--.

UNITED STATES PATENT AND TRADEMARK OFFICE

CERTIFICATE OF CORRECTION

PATENT NO. : 5,504,510

DATED : April 2, 1996

INVENTOR : AKIRA MIYAKAWA

It is certified that error appears in the above-identified patent and that said Letters Patent is hereby corrected as shown below:

COLUMN 6

Line 42, "which" should read --in which--.

COLUMN 7

Line 32, "F" should read --8--;
Line 33, "line" should read --line in--;
Line 45, "corrects," should read --correctly.--.

COLUMN 8

Line 10, "eject" should read --ejects--;
Line 43, "exist" should read --exists--.

COLUMN 9

Line 32, "if," should read --if--;
Line 54, "controller 31" should read --controller 51--.

COLUMN 11

Line 45, "state" should read --state of--;
Line 51, "corners" should read --corner--;
Line 57, "process," should read --process-.

UNITED STATES PATENT AND TRADEMARK OFFICE

CERTIFICATE OF CORRECTION

PATENT NO. : 5,504,510

DATED : April 2, 1996

INVENTOR : AKIRA MIYAKAWA

It is certified that error appears in the above-identified patent and that said Letters Patent is hereby corrected as shown below:

COLUMN 12

Line 26, "time," should read --time--;
Line 67, "corners" should read --corner--.

COLUMN 13

Line 23, "preventing" should be deleted.

COLUMN 15

Line 12, "corners" should read --corner--;
Line 48, "embodiments" should read --embodiment--.

COLUMN 16

Line 32, "operations." should read --operation.--;
Line 53, "used a" should be deleted.
Line 67, "actions;" should read --action;--.

UNITED STATES PATENT AND TRADEMARK OFFICE

CERTIFICATE OF CORRECTION

PATENT NO. : 5,504,510

DATED : April 2, 1996

INVENTOR : AKIRA MIYAKAWA

It is certified that error appears in the above-identified patent and that said Letters Patent is hereby corrected as shown below:

COLUMN 17

Line 3, "even" should read --event--;
Line 4, "it" should read --its --.

COLUMN 18

Line 25, "head" should read --heads--;
Line 62, "is the" should read --in the--.

COLUMN 19

Line 38, "tions;" should read --tion;--;
Line 45, "it" should read --its--.

COLUMN 20

Line 4, "operations" should read --operation--;

UNITED STATES PATENT AND TRADEMARK OFFICE

CERTIFICATE OF CORRECTION

PATENT NO. : 5,504,510

DATED : April 2, 1996

INVENTOR : Akira Miyakawa

It is certified that error appears in the above-identified patent and that said Letters Patent is hereby corrected as shown below:

COLUMN 20 continued

Line 13, "it" should read --its--;
Line 17, "operators" should read --operator's--;
Line 28, "advantageous" should read --advantages--.

Signed and Sealed this

First Day of October, 1996

Bruce Lehman

*Attest:*

BRUCE LEHMAN

*Attesting Officer*

*Commissioner of Patents and Trademarks*